US005551893A

United States Patent [19]

Johnson

[11] Patent Number: 5,551,893

[45] Date of Patent: Sep. 3, 1996

[54] ELECTRICAL CONNECTOR WITH GROMMET AND FILTER

[75] Inventor: Bradley G. Johnson, Russell, Pa.

[73] Assignee: Osram Sylvania Inc., Danvers, Mass.

[21] Appl. No.: 240,304

[22] Filed: May 10, 1994

[51] Int. Cl.[6] ..... H01R 13/66

[52] U.S. Cl. ..... 439/620; 333/182; 333/183

[58] Field of Search ..... 439/607, 608, 439/271, 620, 79, 80; 333/182, 183, 184, 185, 12

[56] References Cited

U.S. PATENT DOCUMENTS

| | | | |
|---|---|---|---|
| 4,761,147 | 8/1988 | Gauthier | 439/620 X |
| 4,784,618 | 11/1988 | Sakamoto et al. | 439/620 OR |
| 4,786,260 | 11/1988 | Spaulding | 439/607 OR |
| 4,895,535 | 1/1990 | Emadi et al. | 439/607 X |
| 4,950,185 | 8/1990 | Boutros | 439/620 OR |
| 5,022,870 | 6/1991 | Sakamoto et al. | 439/620 X |
| 5,181,864 | 1/1993 | Wakino et al. | 439/620 OR |
| 5,236,376 | 8/1993 | Cohen | 439/620 OR |
| 5,266,054 | 11/1993 | Duncan et al. | 439/620 |

*Primary Examiner*—P. Austin Bradley
*Assistant Examiner*—Daniel Wittels
*Attorney, Agent, or Firm*—William H. McNeill

[57] ABSTRACT

An electrical connector is provided with a sealing grommet which provides an environmental seal as well as a cushioning shock absorber for a ferrite filter.

4 Claims, 2 Drawing Sheets

ELECTRICAL CONNECTOR WITH GROMMET AND FILTER

TECHNICAL FIELD

This invention relates to electrical connectors and more particularly to an electrical connector having an environmental sealed area between the solder tail end and the harness interface.

BACKGROUND ART

Current methods of providing this seal have included insert molding the electrical contacts into the connector body or the use of potting compounds.

Insert molding of the electrical contacts usually becomes unreliable after the connector is exposed to thermal cycling and the use of potting compounds necessitates a difficult to control process.

DISCLOSURE OF THE INVENTION

It is, therefore, an object of this invention to obviate the disadvantages of the prior art. art.

It is another object of the invention to enhance environmental seals in electrical connectors.

These objects are accomplished, in one aspect of the invention, by the provision of an electrical connector which has a body formed from a substantially rigid electrically insulating material, the body including a transverse portion having a cavity therein. The cavity has a floor with at least one floor aperture therein. A substantially flexible, electrically insulating grommet is fitted within the cavity, the grommet including at least one grommet aperture substantially aligned with the floor aperture. A ferrite filter is positioned adjacent the grommet and in contact therewith, said filter having at least one filter aperture substantially aligned with the grommet aperture and the floor aperture. A cover formed of a substantially rigid, electrically insulating material overlies the filter and is fixed to the transverse portion. The cover has at least one cover aperture therein substantially aligned with the filter aperture, the grommet aperture and the floor aperture, and an electrically conductive contact is fitted within all of the apertures.

Connectors fabricated as described above avoid the application of insert molding techniques and the use of potting compounds. Additionally, the flexible grommet will compress slightly to account for any tolerance stack-up and further, act as a shock absorber to protect the brittle ferrite in the event of rough handling or droppage.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
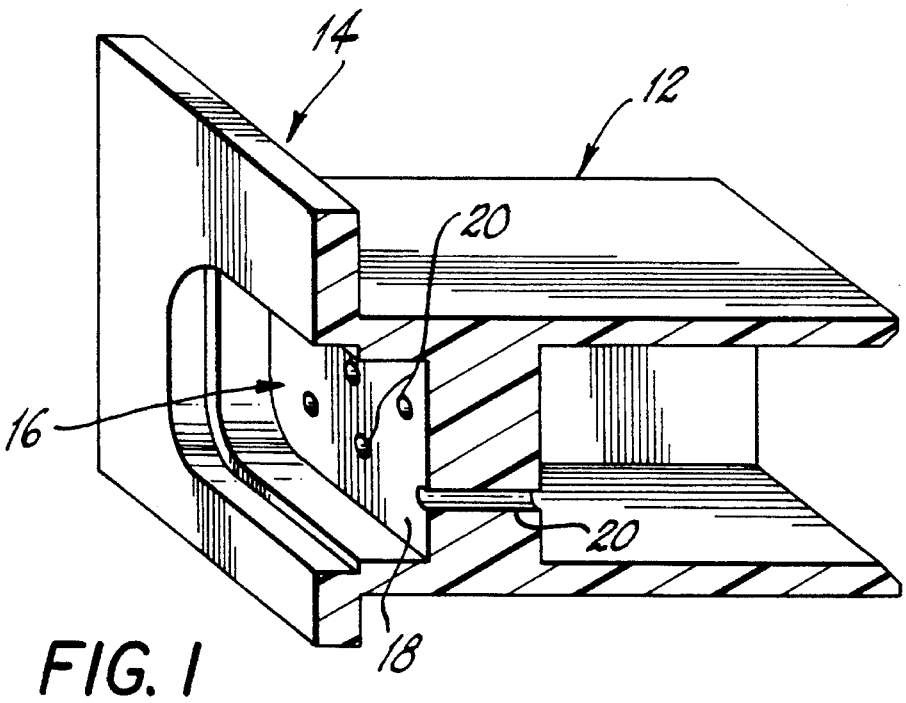
FIG. 1 is a perspective view, partially in section, of a connector body in accordance with an embodiment of the invention.
Figure 2:
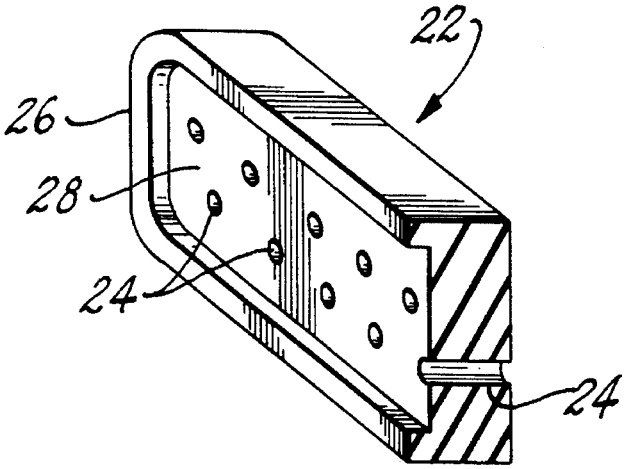
FIG. 2 is a perspective view, partially in section, of a grommet for use with the invention.
Figure 3:
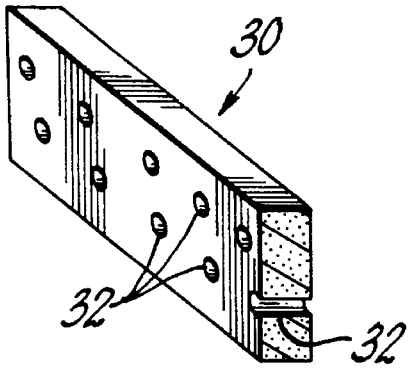
FIG. 3 is a perspective view, partially in section, of a ferrite filter for use with the invention.
Figure 4:
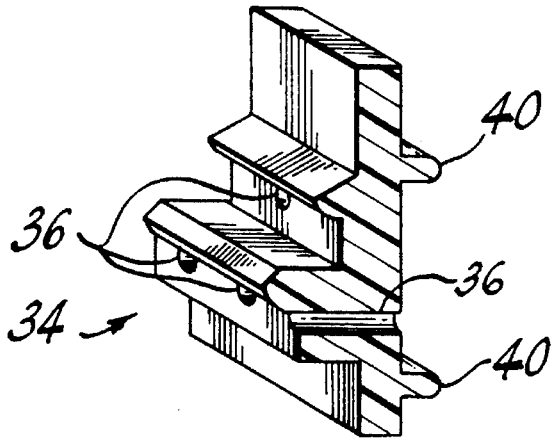
FIG. 4 is a perspective view, partially in section, of a cover for use with the invention.
Figure 5:
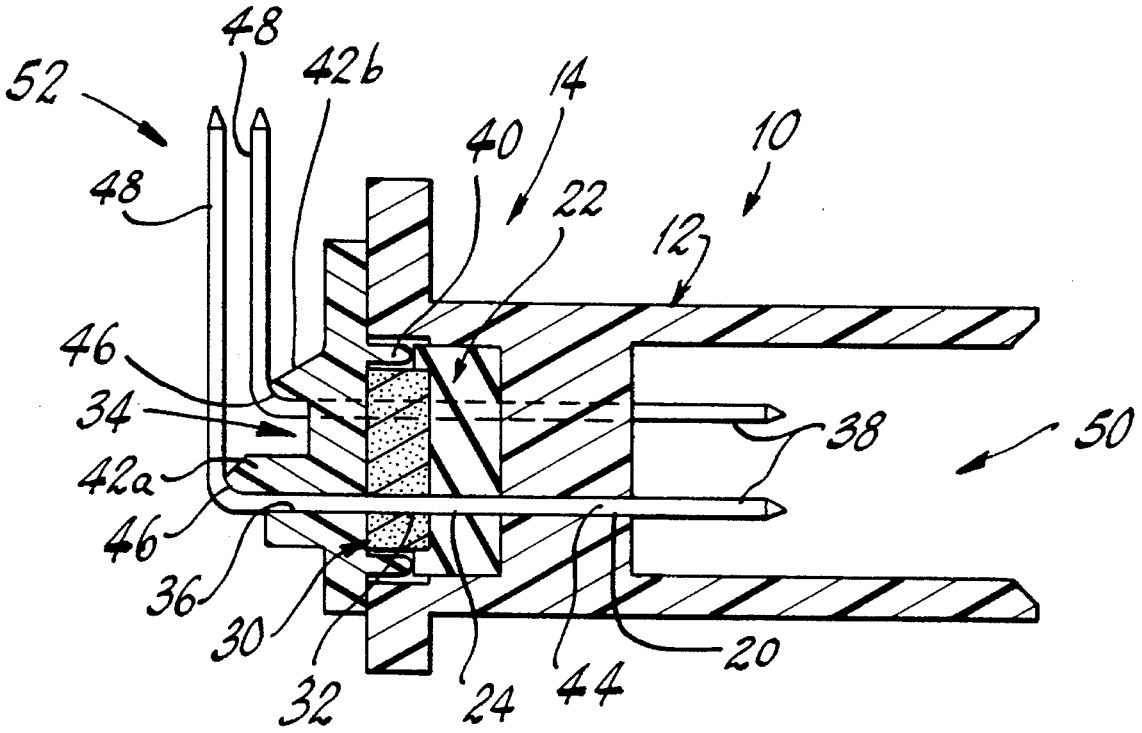
FIG. 5 is an elevational sectional view of an assembled connector in accordance with an embodiment of the invention.

Referring now to the drawings with greater particularity, there is shown in FIG. 5 an electrical connector 10 having a body 12 formed from a substantially rigid electrically insulating material, such, for example, as glass reinforced, polybutylene terephthalate. The body 12 is shown in more detail in FIG. 1 and has a transverse portion 14 having a cavity 16 therein. The cavity 16 has a floor 18 with at least one floor aperture 20 therein. A substantially flexible, electrically insulating grommet 22, of a suitable material, such, for example, as silicone rubber, is fitted within the cavity 16. The grommet 22 (shown in detail in FIG. 2) includes at least one grommet aperture 24 substantially aligned with the floor aperture 20, and has an upstanding peripheral wall 26 therearound defining a sub-cavity 28. A ferrite filter 30 is positioned adjacent the grommet and in contact therewith in the sub-cavity 28. The filter has at least one filter aperture 32 substantially aligned with the grommet aperture 24 and the floor aperture 20. A cover 34 formed of a substantially rigid, electrically insulating material, which preferably is the same material as body 12, overlies the filter and is fixed to the transverse portion 14 by any suitable means. The cover has at least one cover aperture 36 therein substantially aligned with all of the previously mentioned apertures, and an electrically conductive contact 38, which, in a preferred embodiment is cylindrical, is fitted in the apertures.

The cover 34 has an inside, projecting lip 40 which, when the cover is assembled to body 12, contacts the peripheral wall 26 of grommet 22, thus further isolating the fragile ferrite from harm. Projecting lip 40 also allows the option of supplying the connector without the ferrite block.

Additionally, in the embodiment shown, cover 34 on an outside surface, is provided with bend anvils **42*a* and 42*b*. The electrical contacts 38 have a first section 44 fitted in the apertures, a second section 46 in contact with the bend anvils (either 42*a* or 42*b*) and a third section 48** which extends substantially at a right angle to the first section.

The connector thus provided avoids the problems of the prior art offers an environmentally sealed area between the harness interface (i.e., the terminal end of the contacts within hollow space 50) and the solder tail end of the contacts, shown generally at 52. Additionally, the ferrite filter 30 is admirably cushioned by the sealing grommet 22 which also contributes to the environmental seal.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An electrical connector comprising: a body formed from a substantially rigid electrically insulating material, said body including a transverse portion having a cavity therein, said cavity having a floor with at least one floor aperture therein; a substantially flexible, electrically insulating grommet fitted within said cavity, said grommet including at least one grommet aperture substantially aligned with said floor aperture; a ferrite filter positioned adjacent said grommet and in contact therewith, said filter having at least one filter aperture substantially aligned with said grommet aperture and said floor aperture; a cover formed of a substantially rigid, electrically insulating material overlying said filter and fixed to said transverse portion, said cover having at least one cover aperture therein substantially aligned with said filter aperture, said grommet aperture and said floor aperture; and an electrically conductive contact fitted within said aperture.

2. The electrical connector of claim 1 wherein said cover has at least one bend anvil adjacent said at least one cover aperture.

3. The electrical connector of claim 2 wherein said contact has a first section fitted in said apertures, a second section in contact with said bend anvil, and a third section extending substantially at a right angle to said first section.

4. The electrical connector of claim 3 wherein said electrical contact is cylindrical.

* * * * *